United States Patent [19]

Wich et al.

[11] 4,007,931

[45] Feb. 15, 1977

[54] HAND WEAPON

[76] Inventors: Horst W. Wich, 816 Brent; James H. Ibrao, 1221 Monterey Road, both of South Pasadena, Calif. 91030

[22] Filed: Nov. 3, 1975

[21] Appl. No.: 628,573

[52] U.S. Cl. ..... 273/84; 272/75

[51] Int. Cl.[2] ..... F41B 15/10

[58] Field of Search ..... 273/80 D, 80.1, 84 R; 46/62; 63/1 R, 31; 272/74, 75; 135/15 PQ, 46 SH, 46 T, 50; 403/326, 361, 377

[56] References Cited

UNITED STATES PATENTS

| | | | |
|---|---|---|---|
| 674,431 | 5/1901 | Black | 272/75 |
| 1,094,226 | 4/1914 | LeDuc | 273/84 R |
| 1,258,464 | 3/1918 | Riley | 46/62 |
| 1,909,932 | 5/1933 | Digel | 273/84 R |
| 2,655,967 | 10/1953 | Mallory | 403/377 X |
| 2,861,829 | 11/1958 | Jahanson et al. | 403/377 |
| 3,604,565 | 9/1971 | Freeman | 403/361 X |
| 3,606,410 | 9/1971 | Inserra | 273/80.1 X |
| 3,608,899 | 9/1971 | Hall | 273/84 R |
| 3,762,704 | 10/1973 | Gingras | 272/75 |

FOREIGN PATENTS OR APPLICATIONS

| | | | |
|---|---|---|---|
| 296,994 | 3/1917 | Germany | 273/84 R |
| 348,579 | 2/1922 | Germany | 273/84 R |
| 356,481 | 7/1922 | Germany | 273/84 R |

OTHER PUBLICATIONS

"Black Belt;" Aug. 1974; p. 66.

*Primary Examiner*—Richard J. Apley

[57] ABSTRACT

A hand weapon comprising a pair of hollow members which are adapted to be interengaged to form essentially a hollow rod, an elongated flexible member contained within the rod and its two ends being securely fastened within the outer ends of the respective parts of the rod, whereby when only one end of the rod is grasped by hand and swung forcibly about, the other end thereof will slidably disengage and will extend the flexible member to its full length.

4 Claims, 5 Drawing Figures

HAND WEAPON

BACKGROUND OF THE INVENTION

Various types of hand weapons have heretofore been known for use in self-defense and for other purposes. The techniques of karate and other methods of self-defense have become very refined and advanced. For these purposes it is desirable to have a weapon which is small, compact, easily carried, and does not require explosives or chemical substances to provide its actuating force.

The object and purpose of the present invention, therefore, is to provide a fighting weapon which is small, compact, easily carried, and operated entirely by hand power, but which is nevertheless very effective.

SUMMARY OF THE INVENTION

According to the present invention a hollow rod is made in two longitudinal sections whose inner ends are adapted to interfit in a longitudinal sliding relationship. An elongated flexible member having a length at least twice as great as the length of the rod is folded up inside the rod. Respective ends of the flexible member are permanently fastened within the corresponding outer ends of the rod.

Since the weapon is typically less than a foot in length, it can easily be carried in a pocket or in one hand.

In one mode of using the weapon it is grasped near its longitudinal center in one hand, the hand grip serving to hold the two halves of the rod together. The weapon then provides a weight which can be used to achieve a striking action with either one of its ends.

In the other mode of operation of the invention, the rod is grasped by one end only. It is then forcibly swung around so that the other end of the rod will slide longitudinally outward, thus separating the two parts of the rod. The flexible member then extends to its full length. The user of the weapon then holds the one end of the rod in his hand, swinging the weapon around so that the other rod portion carried on the remote end of the flexible member can be used to achieve a very heavy striking force.

In yet a third method of using the invention, the two rod portions are separated and one is held in each hand, and the flexible member intervening between them may be used to encircle the neck or other body portion of an opponent.

DRAWING SUMMARY

PREFERRED EMBODIMENT

Figures 1, 2, 3, 4, 5:
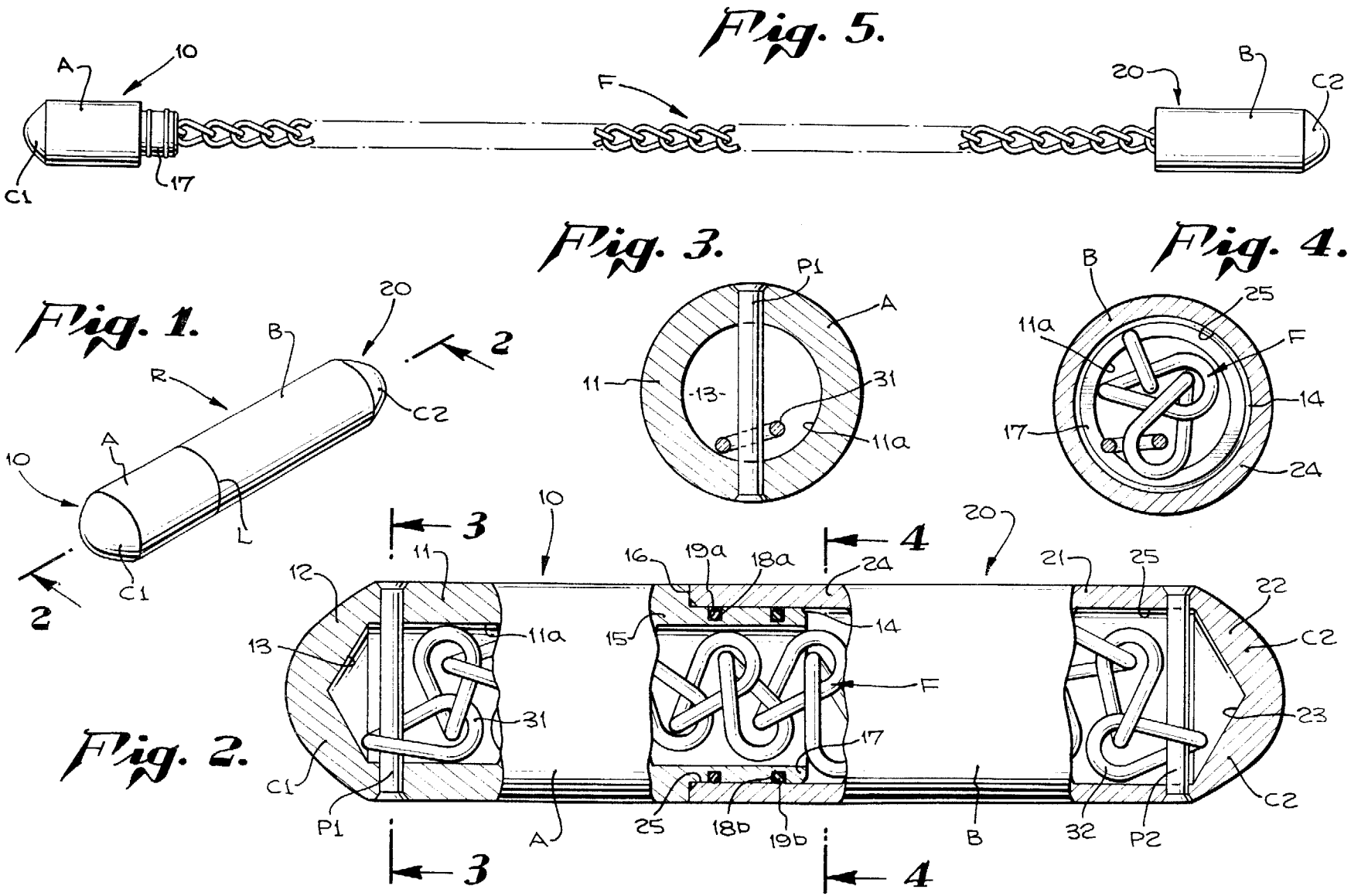
FIG. 1 is a perspective view of the invention.
FIG. 2 is a side view of the invention with parts thereof broken away in longitudinal cross-section.
FIG. 3 is a fragmentary cross-sectional view taken on line 3—3 of FIG. 2.
FIG. 4 is a fragmentary cross-sectional view taken on line 4—4 of FIG. 2.
FIG. 5 is a side view of the invention when the two rod portions are separated and the flexible member is fully extended between them.

Referring now to the drawing, the weapon of the present invention is usually carried in the manner shown in FIG. 1, where it appears as a rod R having two longitudinal parts A and B which are separated on a circumferential parting line L. The rod part A has a closed dome-shaped outer end CI while the rod part B has a closed, dome-shaped outer end C2.

Interior construction of the device is shown in FIGS. 2 through 4. A first generally cyclindrical member 10 has a cylindrical outer surface A. It has a relatively thick circumferential wall 11 with a cylindrical inner surface 11*a*. At the outer end of member 10 there is an end wall 12 which provides the dome-shaped outer end surface C1. The inner surface 13 of end wall 12 is cut to a shallow conical configuration. The inner end 15 of member 10 has a radially extending outer shoulder 16 which joins the cylindrical outer surface A. Radially inwardly from the shoulder 16 the inner portion of circumferential wall 11 extends longitudinally inwardly of the composite weapon as shown in FIG. 2, forming a cylindrical flange 17. Flange 17 on its outer cylindrical surfaces has a pair of longitudinally spaced grooves 18*a*, 18*b*. Elastomeric O-rings 19*a*, 19*b* are received within respective ones of the grooves. On its end face the flange 17 has a chamfered outer circumferential corner 14.

The second member 20 has a relatively thin circumferential wall 21. Wall 21 provides the cylindrical outer surface B and also has a cylindrical inner surface 25. At its outer end the member 20 has an end wall 22 whose outer surface provides the dome-shaped end C2, while its inner surface 23 is cut in a shallow conical configuration.

When the two rod parts 10 and 20 are longitudinally fitted together, the chamfer 14 of flange 17 provides a reliable centering action for inserting the flange within the end opening of member 20. The elastomeric O-rings 19*a*, 19*b* then form a relatively tight but nonetheless easily slidable seal with the inner cylindrical surface 25 of the member 20.

Flexible member F is preferably a metal chain as illustrated. The respective end links of the chain are designated as 31 and 32. A pin P1 (FIG. 3) passes transversely through the outer end of member 10 and captures the corresponding end link 31 of the chain F. In similar fashion a pin P2 (FIG. 2) passes transversely through the outer end of member 20 and captures the corresponding end link 32 of the chain.

ALTERNATE FORMS

For purpose of use as a real weapon it is preferred to make both of the rod sections of metal, as illustrated in the drawing. Any desired type of metal may be used. The flexible member F may be a rope or cord or a wire, but for purpose of a real weapon is preferably a metal chain as illustrated.

While the end walls 12 and 22 are presently illustrated as being fully enclosed, it may be preferred to form an opening in at least one of these end walls in order to permit the more rapid ingress and egress of air, which facilitates the longitudinal sliding action of the two rod portions when the weapon is to be extended, as well as facilitating the subsequent reassembly of the rod parts.

When the invention is to be used as a toy, it is preferred to make the two rod parts from a plastic material, and the flexible member F may then be a string or cord or very lightweight chain. When the rod parts are made of plastic the use of the O-rings 19*a*, 19*b* is not necessary.

As presently illustrated the parting line L is asymmetric; however, it may if desired be located in the precise longitudinal center of the device.

The fasteners P1 and P2 are presently illustrated as dowel pins. Rivets or other types of fasteners may be used if desired. While the pins P1 and P2 are shown as extending transverse to the hollow rod portions, other types and arrangements of fastening devices may also be used so long as the respective ends of the flexible member are secured within the outer ends of the rod.

In its presently preferred form the rod R is approximately 1⅞ inches in diameter and has a length of approximately 8¾ inches between the points of the dome-shaped caps C1, C2. The preferred length of the chain F is 28 inches. However, other dimensions may be used as desired.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A hand weapon comprising:

first and second generally cylindrical metallic members whose inner ends are slidably interengaged and whose outer ends are dome-shaped and substantially fully enclosed, said members except for said dome-shaped ends being of uniform diameter throughout their length, said diameter being such as to be conveniently grasped by hand, and each of said members being elongated whereby said members together form an elongated rod;

one of said cylindrical members having a relatively thin circumferential wall, the other member having a relatively thick circumferential wall whose inner end has a projecting interior flange portion that is slidably received within the inner end of said one member;

a pair of fastening pins, one within the outer end of each of said cylindrical members, each said pin extending transversely within the associated member and having its outer ends secured in the outer circumferential wall of the member; and an elongated flexible metal chain whose length is at least twice the length of said rod, the end links of said chain being captured upon corresponding ones of said fastening pins, and said chain occupying the interior space of both of said cylindrical members and being loosely folded up therein;

whereby said weapon may be used as a weight for striking purposes by grasping same with one hand near its longitudinal center and using the hand grip to hold said two members together; and whereby, alternatively, the user may grasp one of said cylindrical members only, and swing said weapon about so that the other member slides longitudinally outward and said flexible chain then becomes extended to its full length.

2. The weapon of claim 1 wherein said flange has a pair of circumferential grooves formed on its exterior surface, and said weapon further includes a pair of elastomeric O-rings occupying respective ones of said grooves and forming a relatively tight but nonetheless slidable seal with the inner end of said one member.

3. The weapon of claim 2 wherein the other end of said flange is chamfered thereby providing a reliable centering action when said flange is inserted within the end opening of said one member.

4. The weapon of claim 1 wherein the parting line between said two cylindrical members is longitudinally asymmetric, said thin-walled member being of greater length than said thick-walled member.

* * * * *